US005550525A

United States Patent [19]

Place

[11] Patent Number: 5,550,525

[45] Date of Patent: Aug. 27, 1996

[54] SWITCH WITH BIMETALLIC ELEMENT

[75] Inventor: Donald E. Place, Mansfield, Ohio

[73] Assignee: Therm-0-Disc, Incorporated, Mansfield, Ohio

[21] Appl. No.: 276,998

[22] Filed: Jul. 19, 1994

[51] Int. Cl.[6] ..... H01H 37/52; H01H 37/54; H01H 37/04; H01H 37/66

[52] U.S. Cl. ..... 337/363; 337/366; 337/381; 337/344

[58] Field of Search ..... 337/41, 53, 54, 337/59, 89, 90, 337, 343, 344, 345, 365, 381, 366, 363

[56] References Cited

U.S. PATENT DOCUMENTS 3,589,846 6/1971 Place .
3,601,675 8/1971 Radtke ..... 318/471
3,648,476 3/1972 Linstromberg .
3,660,005 5/1972 Willson .
4,806,899 2/1989 Merchant ..... 337/378

*Primary Examiner*—Leo P. Picard
*Assistant Examiner*—Stephen T. Ryan
*Attorney, Agent, or Firm*—Jones, Day, Reavis & Pogue

[57] ABSTRACT

A single pole double throw thermostatic switch has a pair of fixed contacts on opposite sides of a movable contact. A U-shaped bimetal member having a pair of spaced end portions has one end portion attached to a switchcase and the other end portion carries the movable contact.

3 Claims, 4 Drawing Sheets

SWITCH WITH BIMETALLIC ELEMENT

BACKGROUND OF THE INVENTION

This application relates to the art of switches and, more particularly, to thermostatic switches. The invention is particularly applicable for use as a sensor switch in controls for gas burners and will be described with specific reference thereto. However, it will be appreciated that the invention has broader aspects and can be used in other environments.

U.S. Pat. No. 3,589,846 discloses a single pole single throw thermostatic switch that is normally closed at ambient temperature. When an igniter for a gas burner is energized, radiant heat received by a bimetal in the switch eventually opens the contacts and the control circuit then opens a gas supply valve for the burner. Radiant heat from the burner maintains the bimetal at an elevated temperature to keep the contacts open. In a switch of the type described, a burner flameout can result in the undesirable continued flow of raw gas if the switch malfunctions with the contacts open. It would be desirable to have an arrangement for checking on the condition of the sensor switch.

SUMMARY OF THE INVENTION

A thermostatic switch of the type described is provided with an additional fixed contact to form a single pole double throw thermostatic switch. When the normally closed contacts open, the other pair of contacts are closed and this allows a microprocessor in a control circuit to verify positive make and break conditions of the switch.

The switch includes a substantially U-shaped bimetal blade having a pair of spaced-apart legs with connected inner end portions and opposite outer end portions. One outer end portion on one of the legs is attached to a switchcase and the other outer end portion on the other leg carries a movable contact. A pair of first and second fixed contacts are positioned on opposite sides of the movable contact. The movable contact normally engages the first fixed contact at ambient temperatures. The bimetal blade moves in response to an elevated temperature condition for moving the movable contact out of engagement with the first fixed contact and into engagement with the second fixed contact.

The switch includes a switchcase having opposite endwalls, opposite sidewalls and a front wall. A pair of spaced-apart parallel terminal members are attached to the outer surface of the front wall and have terminals extending outwardly beyond one of the endwalls. The first fixed contact and the movable contact are connected with these two terminal members. A third terminal member connected with the second fixed contact extends through the front wall between the pair of terminal members.

In a preferred arrangement, the third terminal member includes a transversely bent inner end portion having the second fixed contact thereon. The inner end portion is selectively bendable toward and away from the first fixed contact to adjust the gap therebetween. The first fixed contact is also selectively adjustable toward and away from the movable contact for calibration.

A permanent magnet is associated with the first fixed contact and an armature is associated with the movable contact so that the switch is snap acting.

It is a principal object of the present invention to provide an improved single pole double throw thermostatic switch.

It is also an object of the present invention to provide a thermostatic sensor switch with an additional fixed contact for cooperation with a movable contact for allowing a microprocessor to check on the switch condition.

It is a further object of the invention to provide a single pole double throw thermostatic switch by modifying a single pole single throw switch in a manner that is economical and easy to assemble.

DESCRIPTION OF A PREFERRED EMBODIMENT

Figure 1:
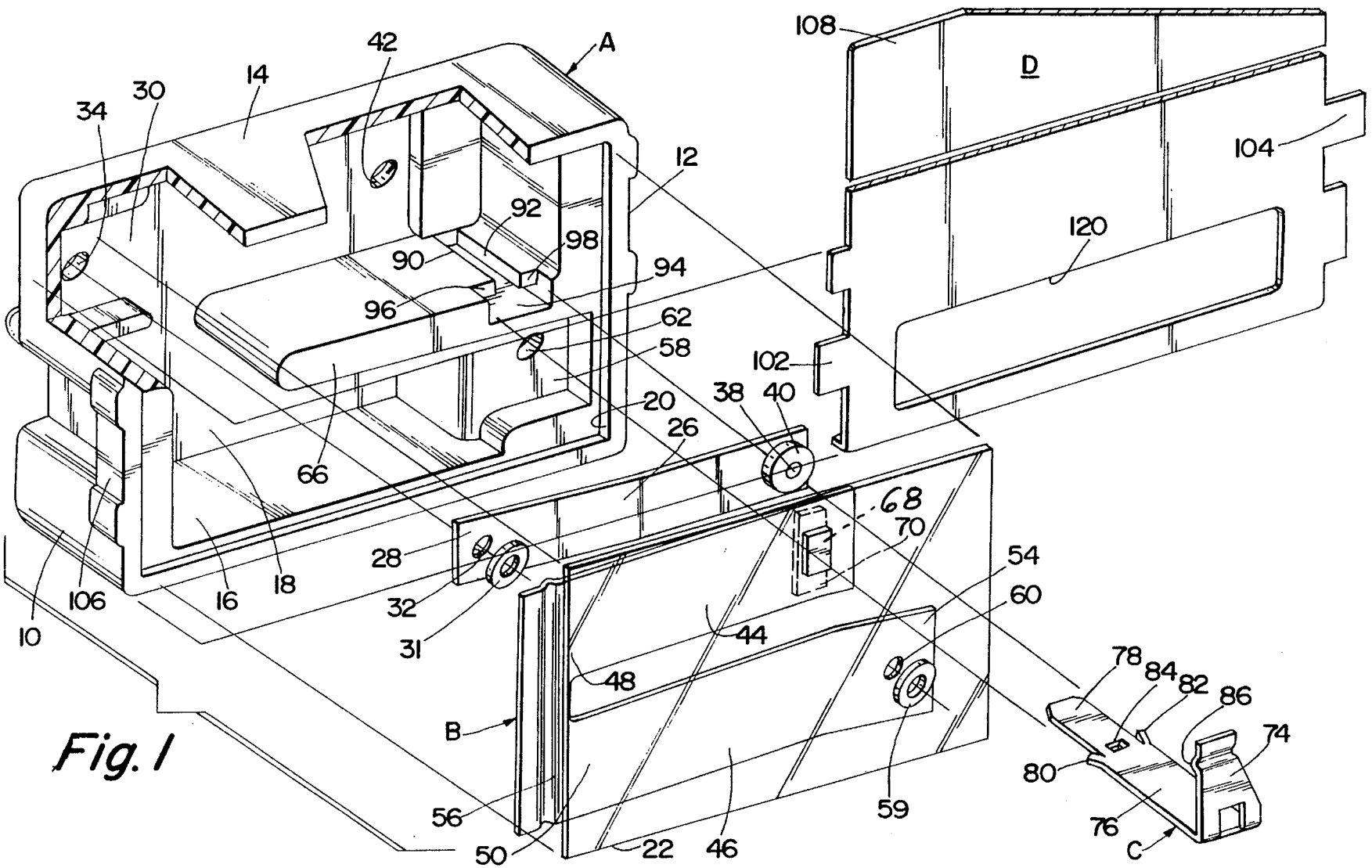
FIG. 1 is an exploded perspective illustration of a thermostatic switch constructed in accordance with the present application.

Referring now to the drawing, wherein the showings are for purposes of illustrating a preferred embodiment of the invention only and not for purposes of limiting same, FIG. 1 shows a switchcase A having opposite endwalls 10, 12, opposite sidewalls 14, 16 and a front wall 18. The open back of switchcase A has a peripheral recess 20 therein for receiving a transparent glass plate 22.

A bendable fixed contact blade 26 has a mounting end portion 28 positionable against a surface 30 in switchcase A. A rivet is extended through washer 31, blade hole 32 and switchcase hole 34 for attaching fixed contact blade 26 to switchcase A.

A first fixed contact 38 carried by the other end portion of blade 26 is surrounded by a permanent magnet 40. A threaded hole 42 in front wall 18 of switchcase A receives a set screw that is accessible from the outer surface of front wall 18 to bend blade 26 for adjusting the position of first fixed contact 38 to calibrate the switch. This adjustment selectively moves the first fixed contact 38 toward or away from a movable contact for calibration purposes.

A substantially flat U-shaped bimetal member B has a pair of spaced-apart legs 44, 46 with connected ends 48, 50 and free outer end portions 52, 54. A transverse bend 56 extends across the connected ends for stiffening purposes. Free outer end portion 54 also defines a mounting end portion that is positionable against a surface 58 in switchcase A. A rivet extends through washer 59, hole 60 in mounting end portion 54 and a hole 62 in switchcase A for attaching bimetal member B to switchcase A. Bimetal legs 44, 46 are then positioned on opposite sides of a switchcase dividing wall 66. Free outer end portion 52 of bimetal leg 44 carries a movable contact 68 that extends on both sides of end portion 52. An armature 70 is attached to end portion 52 on the side thereof facing toward permanent magnet 40.

A generally L-shaped terminal member C has a transversely bent inner end portion 74 and an elongated main leg 76 that terminates in a reduced width terminal 78 to provide shoulders 80, 82. A rectangular opening 84 is provided in leg 76 adjacent shoulders 80, 82 to facilitate transverse bending of terminal 78. Bent inner end portion 74 is transversely deformed as indicated at 86 to provide a second fixed contact facing toward movable contact 68. The surface of second fixed contact 86 that faces toward the movable contact is preferably provided with a silver coating.

Switchcase A has a pair of opposite projections 90, 92 spaced from a flat surface 94 on dividing wall 66 to form a slot for receiving main leg 76 on terminal C. The slot continues through front wall 18 for receiving terminal 78 along with shoulders 80, 82. Main leg 76 of terminal member C is pushed into the slot until bent inner end portion 74 bottoms out against ends 96, 98 of projections 90, 92. In this position, bent inner end portion 74 is bendable relative to main leg 76 toward and away from first fixed contact 38 to adjust the gap therebetween.

Figure 3:
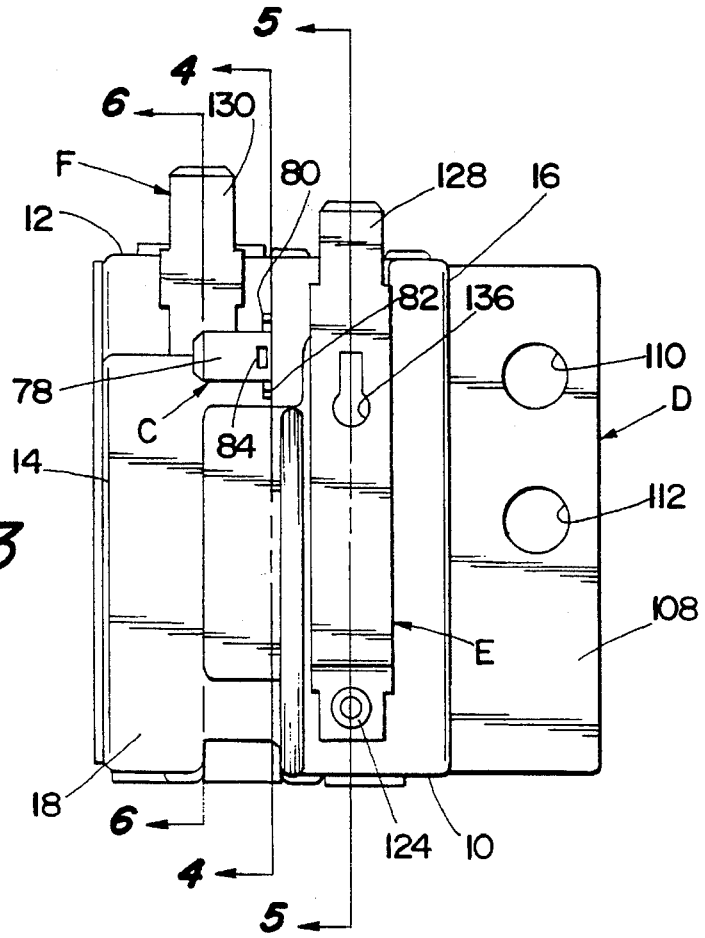
FIG. 3 is a front elevational view of the switch.
Figure 4:
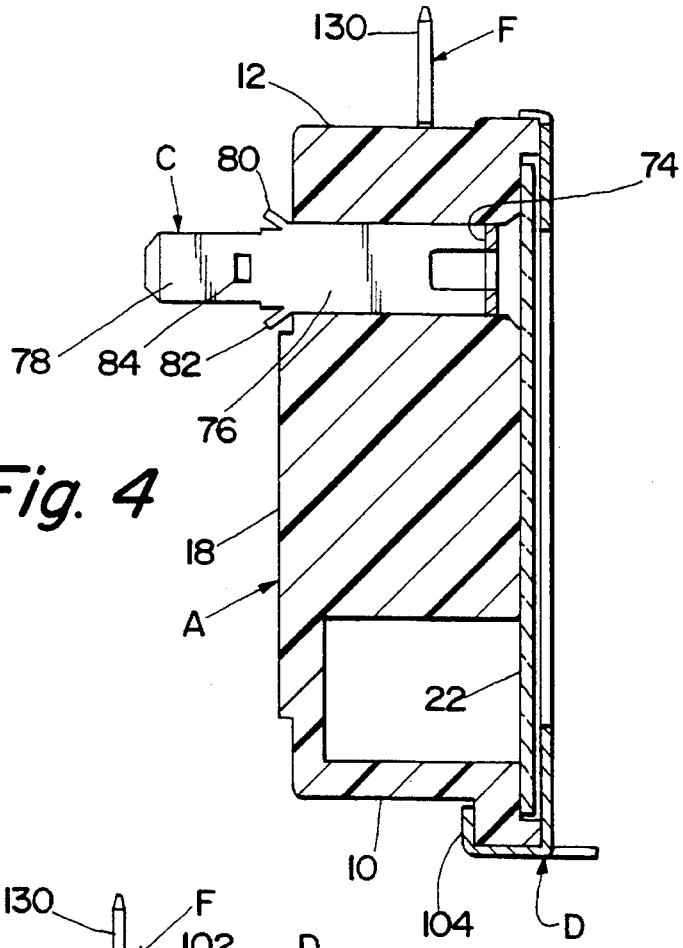
FIG. 4 is a cross-sectional elevational view taken generally on line 4—4 of FIG. 3.

After assembly of the components within switchcase A, transparent glass plate 22 is positioned in recess 20. A metal cover plate D is then positioned over the glass plate. Securing tabs 102, 104 on cover plate D are bendable over shoulders on switchcase endwalls 10, 12 and only one of such shoulders is shown at 106 for endwall 10 in FIG. 1. Cover plate D is larger than the open back of switchcase A to provide an extended mounting portion 108 with holes 110, 112 (FIG. 3) therethrough for receiving fasteners to mount the switch in a desired position. Cover plate D has a window opening 120 therethrough aligned with bimetal leg 46. Radiant heat striking bimetal leg 46 through window 120 and glass plate 22 causes leg 44 to bend in a direction for separating normally closed contacts 38, 68 and for closing normally open contacts 68, 86. Heat radiates from bimetal leg 44 to switchcase A and cover plate D so that there is always a temperature differential between bimetal legs 44, 46 under elevated temperature conditions when leg 46 is receiving radiant heat from an igniter or burner.

Figure 2:
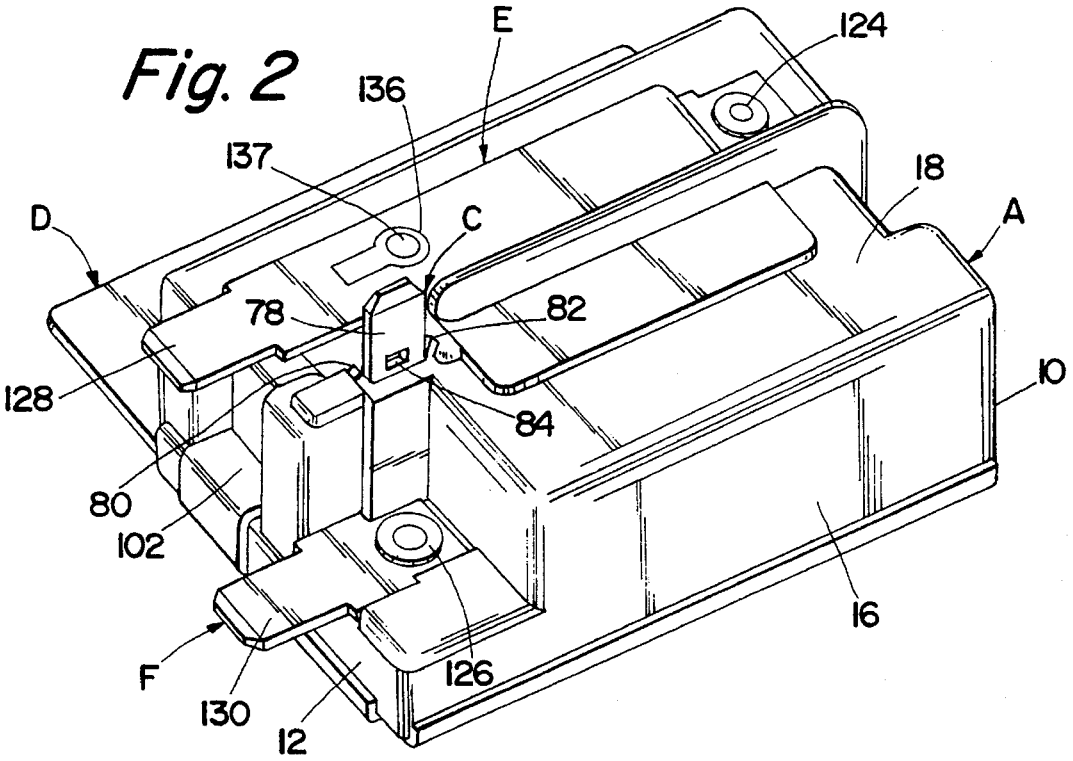
FIG. 2 is a perspective illustration showing the exterior of the switch and the location of terminal members thereon.

FIG. 2 shows first and second terminal members E, F attached to the outer surface of front wall 18 in parallel spaced-apart relationship by rivets 124, 126. Rivet 124 also secures mounting end portion 28 of fixed contact blade 26 to switchcase A so that terminal member E is connected with first fixed contact 38. Rivet 126 also secures mounting end portion 54 of bimetal member B to switchcase A so that terminal member F is connected with movable contact 68. Terminal 78 of third terminal member C extends through front wall 18 substantially perpendicular thereto and is located between terminals E, F closely adjacent switchcase endwall 12. Shoulders 80, 82 on contact member C are staked outwardly as shown in FIG. 2 for securing terminal member C to switchcase A. Terminal 78 on terminal member C is transversely bendable to the position shown in FIG. 3 extending substantially parallel to the outer surface of front wall 18.

Terminal members E, F have terminals 128, 130 extending outwardly from switchcase A beyond endwall 12. Terminal member E has an opening 136 therein aligned with set screw 137 for providing access to the set screw from the exterior of switchcase A to adjust blade 26 and fixed contact 38. After calibration has been completed, opening 136 is filled with epoxy to lock set screw 137 in its adjusted position.

Figure 5:
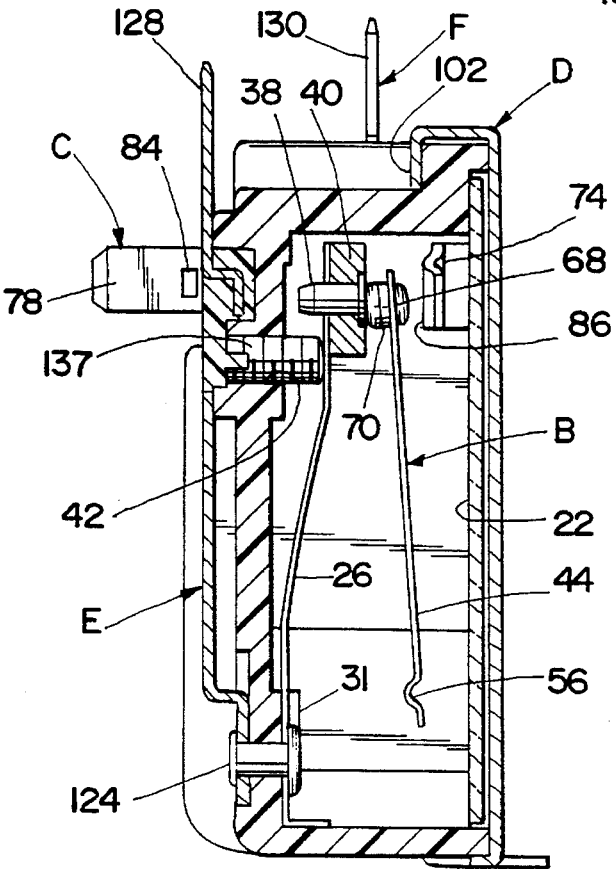
FIG. 5 is a cross-sectional elevational view taken generally on line 5—5 of FIG. 3.
Figure 6:
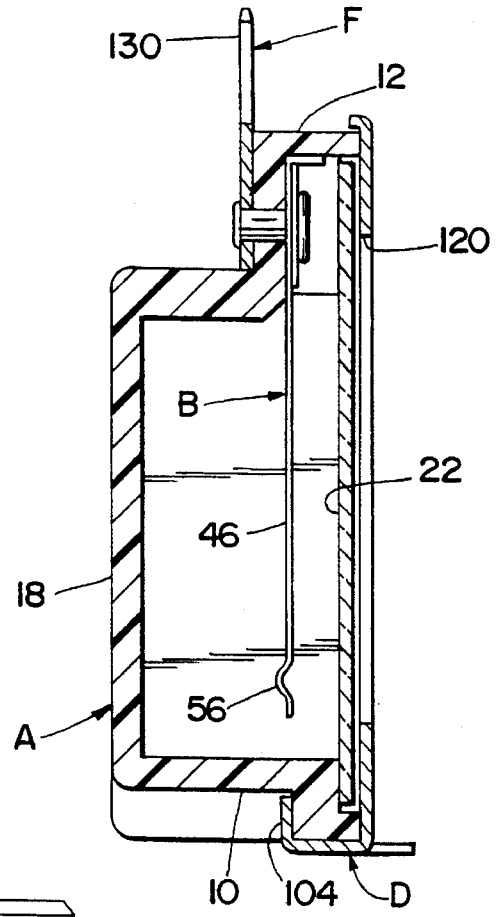
FIG. 6 is a cross-sectional elevational view taken generally on line 6—6 of FIG. 3.
Figure 7:
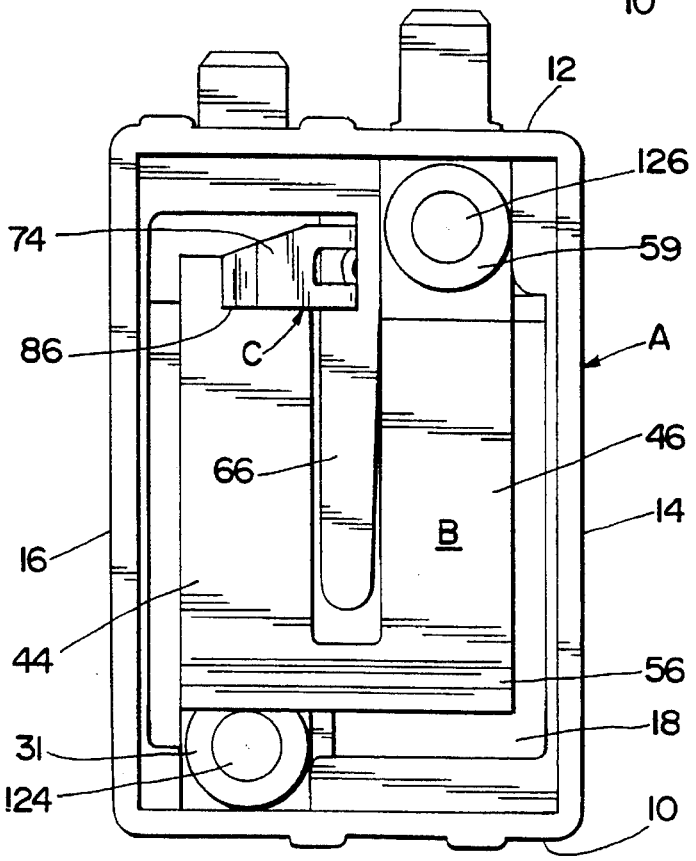
FIG. 7 is a rear elevational view of the switch with the cover removed for viewing of the interior of the switchcase.

FIG. 5 shows the switch in its normally closed position with movable contact 68 engaging first fixed contact 38. Under elevated temperature conditions, bimetal member B moves to separate contacts 38, 68 and to engage movable contact 68 with second fixed contact 86. Reduction of the elevated temperature will cause the contacts to move back to the position shown in FIG. 5. Permanent magnet 40 and armature 70 provide snap acting movement of movable contact 68 in both directions. FIGS. 6 and 7 provide additional views of the components within the switchcase. A microprocessor can be used to monitor the condition of the switch.

U-shaped bimetal member B is manufactured flat with flat legs 44, 46 spaced-apart in the same plane. The transverse spacing between legs 44, 46 does not change as leg 44 moves responsive to temperature changes.

Although the invention has been shown and described with respect to a preferred embodiment, it is obvious that equivalent alterations and modifications will occur to others skilled in the art upon the reading and understanding of this specification. The present invention includes all such alterations and modifications, and is limited only by the scope of the claims.

I claim:

1. A thermostatic switch including a substantially U-shaped bimetal blade having a pair of spaced-apart legs with connected end portions and outer end portions, a switchcase having one of said outer end portions on one of said legs attached thereto, a movable electrical contact on the other of said outer end portions on the other of said legs, a pair of fixed electrical contacts on opposite sides of said movable electrical contact, said movable electrical contact being in engagement with one of said fixed electrical contacts under ambient temperature conditions, said bimetal blade being movable responsive to an elevated temperature condition for moving said movable electrical contact out of engagement with said one fixed electrical contact and into engagement with the other of said fixed electrical contacts, said switchcase having opposite endwalls, opposite sidewalls and a front wall, a plurality of terminal members attached to said switchcase, first and second ones of said terminal members being connected respectively with said one outer end portion of said one leg and with said one fixed electrical contact, a third of said terminal members being connected with said other fixed electrical contact, said first and second terminal members extending along said front wall in spaced-apart parallel relationship and projecting outwardly beyond one of said endwalls, and said third terminal member extending through said front wall between said first and second terminal members in a direction substantially perpendicular to said first and second terminal members.

2. The switch of claim 1 wherein said third terminal member extends through said front wall adjacent said one of said endwalls.

3. The switch of claim 1 wherein said third terminal member includes a transversely bent inner end portion having said other fixed electrical contact thereon, said inner end portion being selectively bendable toward and away from said one fixed electrical contact to adjust the gap between said fixed electrical contacts.

* * * * *